US011098413B2

(12) United States Patent
Chang et al.

(10) Patent No.: US 11,098,413 B2
(45) Date of Patent: Aug. 24, 2021

(54) PLATING APPARATUS AND PLATING METHOD

(71) Applicant: EBARA CORPORATION, Tokyo (JP)

(72) Inventors: Shao Hua Chang, Tokyo (JP); Tomonori Hirao, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 15 days.

(21) Appl. No.: 16/154,226

(22) Filed: Oct. 8, 2018

(65) Prior Publication Data

US 2019/0112727 A1 Apr. 18, 2019

(30) Foreign Application Priority Data

Oct. 12, 2017 (JP) ..... JP2017-198557

(51) Int. Cl.

| | |
|---|---|
| ***C25D 17/00*** | (2006.01) |
| ***C25D 21/12*** | (2006.01) |
| ***C25D 7/12*** | (2006.01) |
| ***C25D 21/10*** | (2006.01) |

(52) U.S. Cl.

CPC ..... *C25D 17/001* (2013.01); *C25D 7/12* (2013.01); *C25D 21/10* (2013.01); *C25D 21/12* (2013.01); *C25D 17/008* (2013.01)

(58) Field of Classification Search

CPC ..... C25D 21/10

See application file for complete search history.

(56) References Cited

U.S. PATENT DOCUMENTS

| | | | | |
|---|---|---|---|---|
| 4,324,623 | A * | 4/1982 | Schaer | C25D 21/18 204/235 |
| 6,544,391 | B1 * | 4/2003 | Peace | C25D 5/08 204/198 |
| 2002/0185371 | A1 * | 12/2002 | Ko | C25D 7/0685 204/198 |
| 2004/0262150 | A1 | 12/2004 | Yajima et al. | |
| 2014/0166492 | A1 * | 6/2014 | Shimoyama | C25D 21/10 205/82 |
| 2014/0170303 | A1 * | 6/2014 | Rayner | C25D 1/22 427/58 |
| 2014/0360865 | A1 * | 12/2014 | Kimura | C25D 17/008 204/198 |

FOREIGN PATENT DOCUMENTS

| | | | |
|---|---|---|---|
| JP | 2005-008911 | A | 1/2005 |
| JP | 2014-237865 | A | 12/2014 |
| WO | WO 2004/009879 | A1 | 1/2004 |

* cited by examiner

*Primary Examiner* — Ciel P Contreras
(74) *Attorney, Agent, or Firm* — BakerHostetler

(57) ABSTRACT

To reduce fluctuation of the liquid level of plating solution caused by the operation of a paddle. A plating apparatus for plating a substrate is provided. The plating apparatus includes: a plating bath configured to store plating solution; a paddle that is arranged in the plating bath and configured to stir the plating solution; and a liquid level fluctuation reducing member that is arranged in the plating bath, has a flow path through which the plating solution passes, and is configured to increase a flow velocity of the plating solution passing through the flow path to attenuate energy of waves formed by the plating solution.

6 Claims, 6 Drawing Sheets

PLATING APPARATUS AND PLATING METHOD

CROSS-REFERENCE TO RELATED APPLICATION

This application is based upon and claims benefit of priority from Japanese Patent Application No. 2017-198557 filed on Oct. 12, 2017, the entire contents of which are incorporated herein by reference.

TECHNICAL FIELD

The present invention relates to a plating apparatus and a plating method.

BACKGROUND ART

An electroplating apparatus including a plating bath for storing plating solution therein, a substrate and an anode that are arranged so as to face each other inside the plating bath, and an adjusting plate arranged between the anode and the substrate is known as an electroplating apparatus adopting a so-called dipping system (see PTL 1, for example). The electroplating apparatus has a paddle for stirring the plating solution between the adjusting plate and the substrate. The paddle moves in a reciprocating direction along the surface of the substrate to stir the plating solution in the vicinity of the surface of the substrate.

In order to enhance the productivity of plating apparatuses, it has been recently required to shorten a plating time required for forming a plating film having a predetermined film thickness. In order to perform plating with a predetermined film thickness in a shorter time for a certain plating area, it is necessary to perform plating at a high plating speed by causing a higher current to flow, that is, it is necessary to perform plating at a high current density. When plating is performed at such a high current density, the paddle is moved at a high speed to promote supply of ions to the surface of the substrate, thereby enhancing the quality of the plating.

CITATION LIST

Patent Literature

PTL 1: International Publication No. WO 2004/009879

SUMMARY OF INVENTION

Technical Problem

It has been recently required to further increase the moving speed of the paddle. However, when the moving speed of the paddle is increased, fluctuation of the liquid level of plating solution intensifies, so that the plating solution may jump out from the plating bath. When the plating solution jumps out from the plating bath, loss of the plating solution occurs. Furthermore, when the plating solution jumping out from the plating bath adheres to other parts of the plating apparatus, it takes time and labor to performing cleaning of the plating apparatus, etc.

The present invention has been made in view of the above problems, and has an object to reduce fluctuation of the liquid level of the plating solution caused by the operation of the paddle.

Solution to Problem

According to one aspect of the present invention, a plating apparatus for plating a substrate is provided. The plating apparatus comprises: a plating bath configured to store plating solution therein; a paddle that is arranged in the plating bath and configured to stir the plating solution; and a liquid level fluctuation reducing member that is arranged in the plating bath, has a flow path through which the plating solution passes, and is configured to increase a flow velocity of the plating solution passing through the flow path to attenuate energy of waves formed by the plating solution.

According to another aspect of the present invention, a plating method for plating a substrate is provided. The plating method comprises a step of storing a substrate and an anode in a plating bath; a step of stirring plating solution stored in the plating bath, and a liquid level fluctuation reducing step of passing the plating solution in the plating bath through a predetermined flow path to increase a flow velocity of the plating solution passing through the flow path, thereby attenuating energy of waves formed by the plating solution.

DESCRIPTION OF EMBODIMENTS

Figure 1:
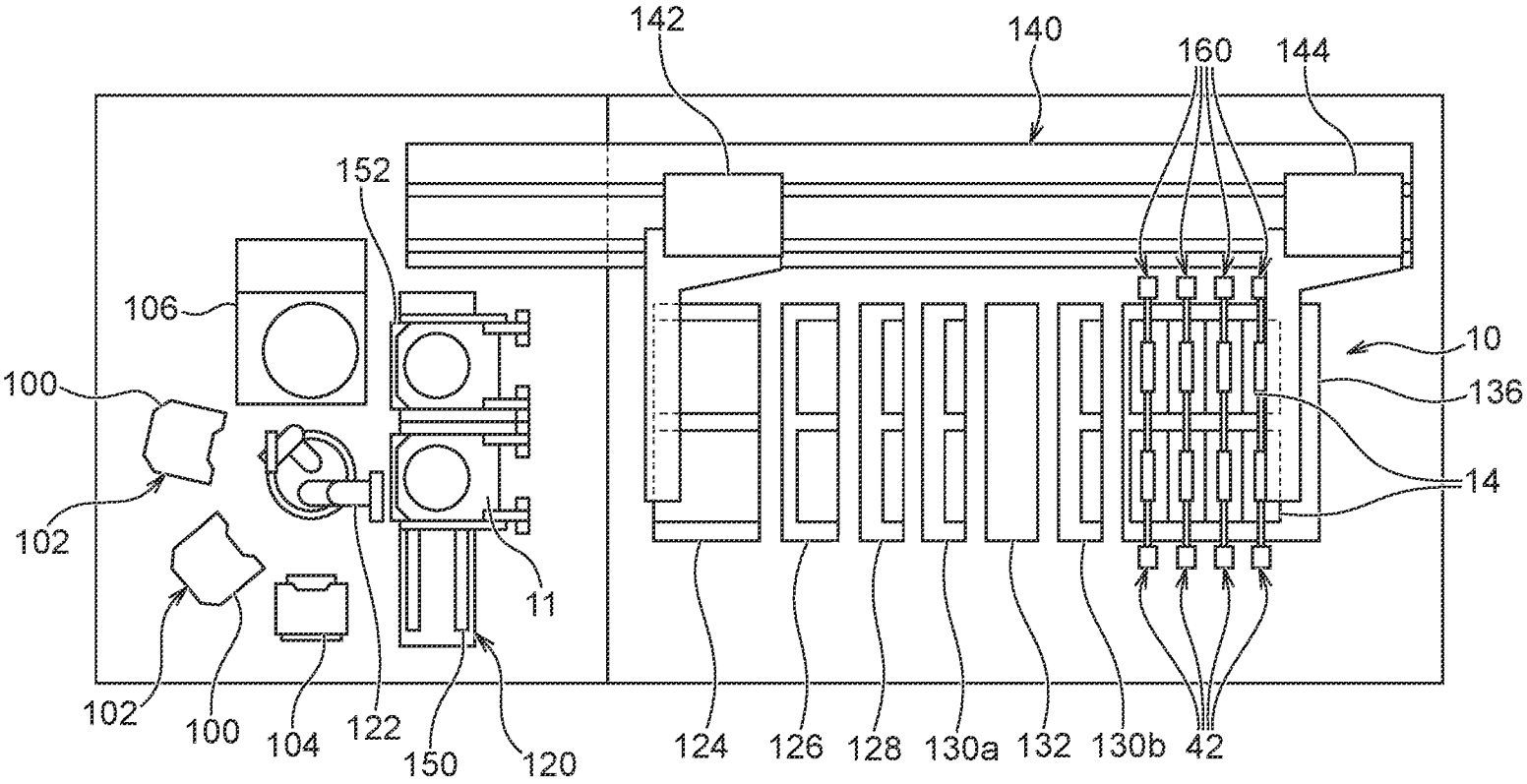
FIG. 1 is an overall arrangement diagram of a plating apparatus according to a present embodiment.

Embodiments of the present invention will be described hereinafter with reference to the drawings. In the drawings described below, the same or corresponding constituent elements are represented by the same reference signs, and duplicate description is omitted.

FIG. 1 is an overall arrangement diagram of a plating apparatus according to the present embodiment. As shown in FIG. 1, the plating apparatus includes two cassette tables 102, an aligner 104 for aligning the positions of an orientation flat, a notch, etc. of a substrate in a predetermined direction, and a spin rinse dryer 106 for rotating the substrate at a high-speed after the plating processing to dry the plated substrate. The cassette table 102 mounts thereon a cassette 100 in which a substrate such as a semiconductor wafer is accommodated. A substrate mounting/demounting unit 120 is provided in the vicinity of the spin rinse dryer 106 in which a substrate holder 11 is carried to mount and demount a substrate. The substrate mounting/demounting unit 120 includes a flat plate-shaped carry plate 152 that is freely slidable in a lateral direction along rails 150. Two substrate holders 11 are horizontally carried side by side on the carry plate 152. After a substrate is delivered between one substrate holder 11 and a substrate transfer device 122, the carry plate 152 is slid in the lateral direction, and a substrate is delivered between the other substrate holder 11 and the substrate transfer device 122. The substrate transfer device 122 which includes a transfer robot configured to transfer substrates among the units 100, 104, 106 and 120 is arranged at the center of the units 100, 104, 106 and 120.

The plating apparatus further includes a stocker 124, a pre-wet bath 126, a pre-soak bath 128, a first cleaning bath 130*a*, a blow bath 132, a second cleaning bath 130*b*, and a plating unit 10. The substrate holders 11 are stocked and temporarily placed in the stocker 124. The substrate is immersed in pure water in the pre-wet bath 126. An oxide film on the surface of a conductive layer such as a seed layer formed on the surface of the substrate is removed by etching in the pre-soak bath 128. The substrate after the pre-soak is cleaned with cleaning liquid (pure water or the like) together with the substrate holder 11 in the first cleaning bath 130*a*. Draining of the substrate after cleaning is performed in the blow bath 132. The substrate after the plating is cleaned with the cleaning liquid together with the substrate holder 11 in the second cleaning bath 130*b*. The substrate mounting/demounting unit 120, the stocker 124, the pre-wet bath 126, the pre-soak bath 128, the first cleaning bath 130 *a*, the blow bath 132, the second cleaning bath 130*b*, and the plating unit 10 are arranged in this order.

The plating unit 10 is configured, for example, so that an overflow bath 136 surrounds the outer peripheries of plural adjacent plating baths 14. Each plating bath 14 is configured so that it accommodates one substrate therein and the substrate is immersed in plating solution held therein to perform plating such as copper plating on the surface of the substrate.

The plating apparatus includes a substrate holder transporting device 140 which adopts, for example, a linear motor system and is located at a side of each of these units to transport the substrate holders 11 with the substrate among these units. The substrate holder transporting device 140 includes a first transporter 142 and a second transporter 144. The first transporter 142 is configured so as to transport substrates among the substrate mounting/demounting unit 120, the stocker 124, the pre-wet bath 126, the pre-soak bath 128, the first cleaning bath 130*a*, and the blow bath 132. The second transporter 144 is configured so as to transport substrates among the first cleaning bath 130*a*, the second cleaning bath 130*b*, the blow bath 132, and the plating unit 10. The plating apparatus may include only the first transporter 142 without including the second transporter 144.

On both sides of the overflow bath 136 are arranged paddle driving units 42 and paddle followers 160 that drive paddles 16 (see FIG. 3) as stirring rods each of which is placed inside each plating bath 14 to stir the plating solution in the plating bath 14.

Figure 2:
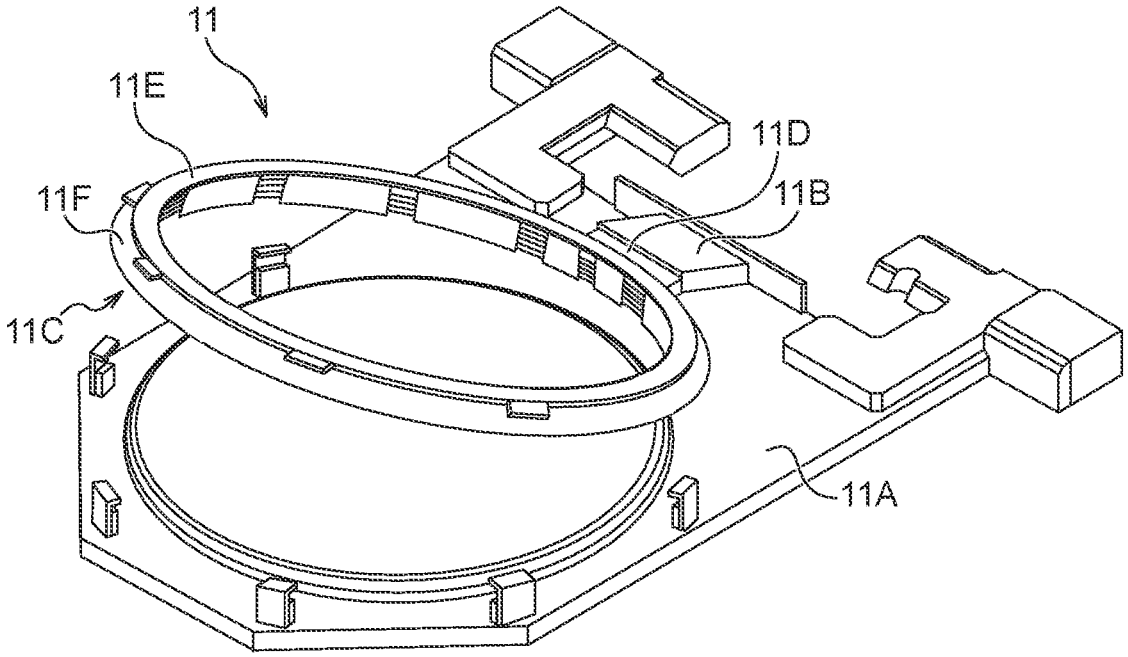
FIG. 2 is a schematically perspective view showing a substrate holder shown in FIG. 1.

FIG. 2 is a schematic perspective view of the substrate holder 11 shown in FIG. 1. As shown in FIG. 2, the substrate holder 11 includes a first holding member 11A made of, for example, vinyl chloride and having a rectangular flat plate shape, and a second holding member 11C that is attached to the first holding member 11A so as to be freely opened and closed via a hinge portion 11B. The second holding member 11C has a base portion 11D connected to the hinge portion 11B, a press ring 11F for pressing the substrate against the first holding member 11A, and a ring-shaped seal holder 11E. The seal holder 11E is configured so as to be slidable with respect to the press ring 11F. The seal holder 11E is made of, for example, vinyl chloride, thereby improving slippage with the press ring 11F. In the present embodiment, the plating apparatus will be described as one for processing a circular substrate such as a wafer. However, the plating apparatus is not limited to this style, and the plating apparatus also may process a rectangular substrate.

Figure 3:
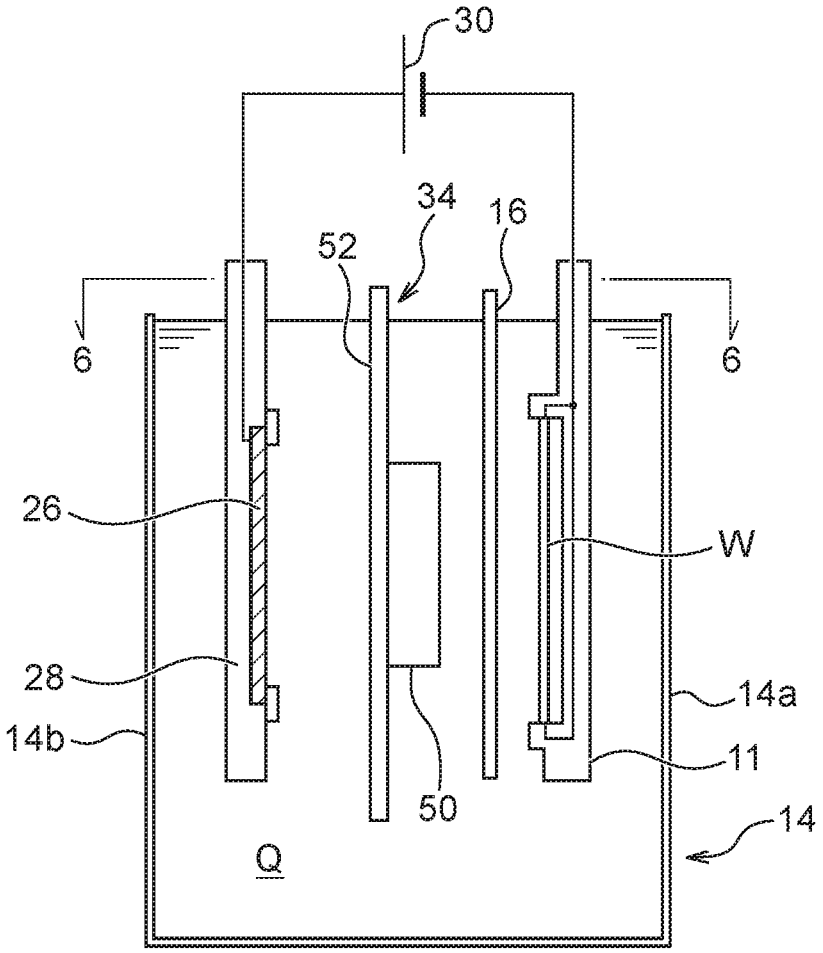
FIG. 3 is a schematic longitudinal-sectional view showing one plating bath of a plating unit shown in FIG. 1.

FIG. 3 is a schematic longitudinal-sectional view showing one plating bath 14 of the plating unit 10 shown in FIG. 1. In FIG. 3, the overflow bath 136 is omitted. The plating bath 14 holds plating solution Q therein and is configured so that the plating solution Q circulates between the plating bath 14 and the overflow bath 136.

The substrate holder 11 that detachably holds a substrate W is accommodated in the plating bath 14. The substrate holder 11 is placed in the plating bath 14 so that the substrate W is immersed in the plating solution Q under a vertical state. An anode 26 held by an anode holder 28 is arranged at a position facing the substrate W in the plating bath 14. For example, phosphorus-containing copper can be used for the anode 26. The substrate W and the anode 26 are electrically connected to each other via a plating power source 30, and current is caused to flow between the substrate W and the anode 26, thereby forming a plating film (copper film) on the surface of the substrate W. The plating bath 14 has a first side wall 14*a* and a second side wall 14*b*, the first side wall 14*a* being positioned on the side of the substrate W, and the second side wall 14*b* being positioned on the side of the anode 26 when the substrate W and the anode 26 are arranged so as to face each other.

The paddle 16 that reciprocates in parallel to the surface of the substrate W and stirs the plating solution Q is arranged between the substrate W and the anode 26. In the present embodiment, the paddle 16 is configured so as to reciprocate in a substantially horizontal direction, but the paddle 16 is not limited to this configuration. The paddle 16 may be configured so as to reciprocate in a vertical direction. By stirring the plating solution Q with the paddle 16, copper ions can be uniformly supplied onto the surface of the substrate W. Furthermore, an adjusting plate (regulation plate) 34 made of a dielectric material for making the potential distribution over the entire surface of the substrate W more uniform is arranged between the paddle 16 and the anode 26. The adjusting plate 34 includes a plate-like main body portion 52 having an opening and a tubular portion 50 attached along the opening of the main body portion 52. The potential distribution between the anode 26 and the substrate W is adjusted according to the size and shape of the opening of the adjusting plate 34.

Figure 4:
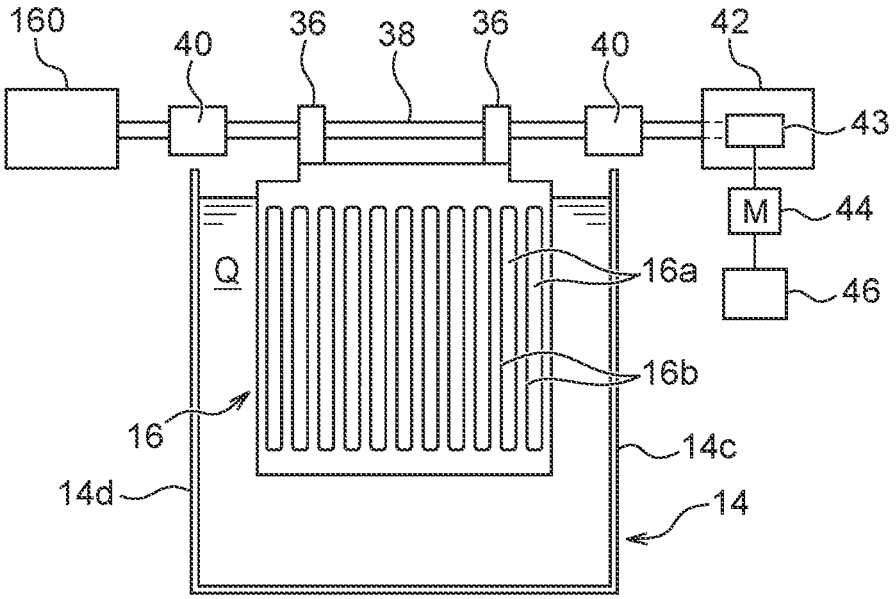
FIG. 4 is a front view showing the plating bath and a paddle driving mechanism.

FIG. 4 is a front view showing the plating bath 14 and the driving mechanism for the paddle 16. As shown in FIG. 4, the paddle 16 is constituted by a rectangular plate-shaped member as a whole, and has plural elongated holes 16*a* in parallel, thereby having plural grid portions 16*b* extending in the vertical direction. The paddle 16 may be formed of a material obtained by coating a Teflon (registered trademark) on a non-magnetic material such as titanium, or a material such as resin material which is not affected by magnetic force.

It is preferable to determine the width and the number of the elongated holes 16*a* such that the grid portions 16*b* are as narrow as possible while having required rigidity so that the grid portions 16*b* efficiently stir the plating solution and the plating solution efficiently passes through the elongated holes 16*a*. Furthermore, the cross-sectional shape of the grid portion 16*b* may be any shape such as a rectangle, a triangle or a rhomboid.

The paddle 16 is fixed to a shaft 38 extending in a substantially horizontal direction by a clamp 36 fixed to the upper end of the paddle 16. The shaft 38 is held by a shaft holding portion 40 so as to be slidable in a right-and-left direction. An end portion of the shaft 38 is connected to a paddle driving unit 42 and a paddle follower 160 that linearly reciprocate the paddle 16 in the right-and-left direction. The paddle driving unit 42 converts rotation of a motor 44 into linear reciprocating motion of the shaft 38 by a motion conversion mechanism 43 such as a crank mechanism or a Scotch yoke mechanism. In this example, a controller 46 for controlling the rotation speed and phase of the motor 44 of the paddle driving unit 42 is provided.

The plating bath 14 has a third side wall 14*c* and a fourth side wall 14*d* that connect the first side wall 14*a* and the second side wall 14*b* shown in FIG. 3. FIG. 4 shows only one plating bath 14, but two or more plating baths 14 may be arranged to be adjacent to each other in the lateral direction as shown in FIG. 1. In that case, two or more paddles 16 are fixed to the shaft 38 so that the two or more paddles 16 reciprocate by one paddle driving unit 42 and a paddle follower 160.

In the plating bath 14 shown in FIGS. 3 and 4, when the paddle 16 reciprocates at a high speed, the liquid level of the plating solution Q fluctuates, so that the plating solution Q may jump out from the plating bath 14. Therefore, in the present embodiment, the liquid level fluctuation reducing member is arranged in the plating bath 14, and immersed in the plating solution Q in order to reduce fluctuation of the liquid level of the plating solution Q caused by the operation of the paddle 16. The liquid level fluctuation reducing member has a flow path through which the plating solution Q in the plating bath 14 passes, and increases the flow velocity of the plating solution Q passing through this flow path. As a result, the energy of waves formed by the plating solution Q is attenuated to reduce the fluctuation of the liquid level.

Figure 5:
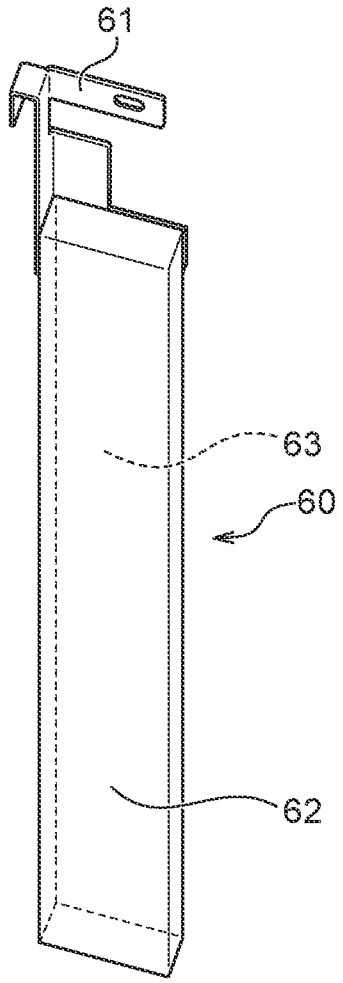
FIG. 5 is a perspective view showing an example of a liquid level fluctuation reducing member according to the present embodiment.
Figure 6:
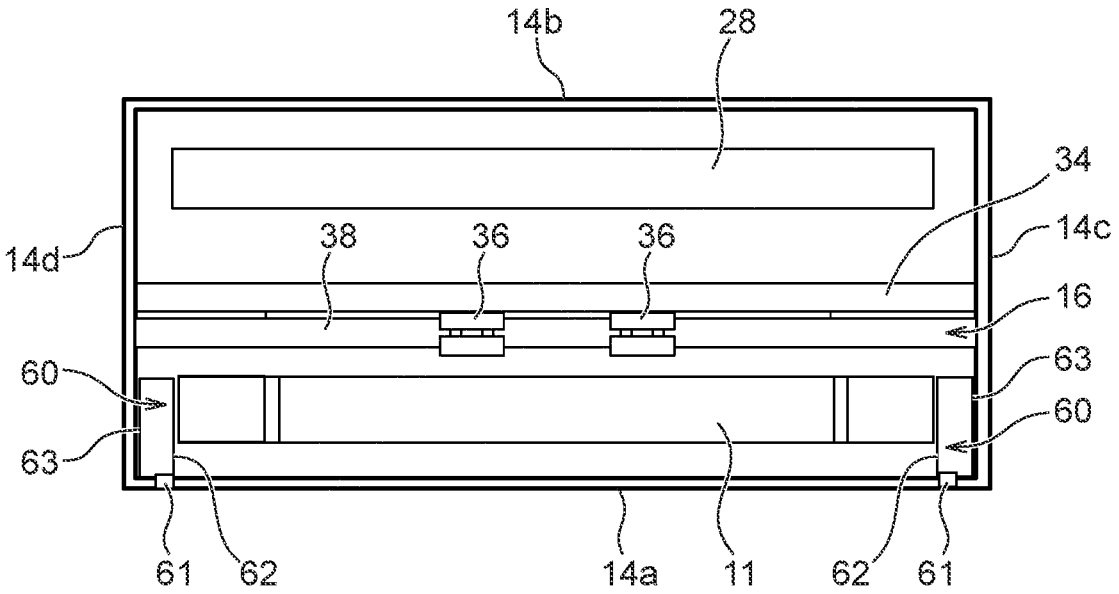
FIG. 6 is a schematic cross-sectional view in an arrow view 6-6 of FIG. 4 of a plating bath in which the liquid level fluctuation reducing member is arranged.

FIG. 5 is a perspective view showing an example of the liquid level fluctuation reducing member according to the present embodiment. FIG. 6 is a schematic cross-sectional view of the plating bath 14 in the arrow view 6-6 of FIG. 3 in which the liquid level fluctuation reducing member is arranged. As shown in FIG. 5, the liquid level fluctuation reducing member of the present embodiment is constituted by a net 60 having plural openings (corresponding to the flow path). The net 60 may be formed of, for example, resin such as polyethylene. In the present embodiment, the shape of the opening of the net 60 is, for example, a rectangle of 1.5 mm×1.5 mm. As shown in FIGS. 5 and 6, the net 60 is formed in a substantially tubular shape, and an end portion thereof is adhesively attached to a bracket 61, for example, by epoxy-resin-based adhesive or the like. The bracket 61 may be formed of titanium, for example.

As shown in FIG. 6, the net 60 is arranged in the plating bath 14 by fixing the bracket 61 to the wall surface of the plating bath 14. At this time, it is preferable that the length of the net 60 in the vertical direction is longer than the length in the vertical direction of a portion of the paddle 16 which is immersed in the plating solution Q shown in FIGS. 3 and 4, whereby it is possible to attenuate the energy of waves (flow) of the plating solution Q formed by the whole portion of the paddle 16 which is immersed in the plating solution Q.

When the paddle 16 moves linearly, the plating solution Q between the paddle 16 and the first side wall 14*a*, that is, the plating solution Q at the portion where the substrate holder 11 is accommodated greatly fluctuates. Particularly, in a case where the paddle 16 continues to operate when no plating is performed in the plating bath 14, that is, when the substrate holder 11 is not temporarily accommodated in the plating bath 14, this fluctuation becomes most intense. Therefore, it is preferable that the net 60 is arranged between the paddle 16 and the first side wall 14*a* of the plating bath 14 as shown in FIG. 6. When another space for arranging the net 60 exists in the plating bath 14, the place where the net 60 is arranged is not limited.

Furthermore, as shown in FIG. 6, it is preferable that at least a part of the net 60 is arranged to be apart from a third side wall 14*c* and a fourth side wall 14*d*. Specifically, as shown in FIG. 6, the net 60 includes a first portion 62 positioned on a center side, and a second portion 63 positioned on a side wall side when the net 60 is arranged in the plating bath 14. That is, in the present embodiment, the first portion 62 is arranged to be apart from the third side wall 14*c* and the fourth side wall 14*d*. As a result, a water retarding portion is formed between the first portion 62 of the net 60 and the third side wall 14*c* or the fourth side wall 14*d*, and when the plating solution Q which has passed through the openings of the first portion 62 flows into the water retarding portion, the energy of the waves (flow) of the plating solution Q can be efficiently attenuated.

When the net 60 is arranged in the plating bath 14 as shown in FIG. 6, the plating solution Q mainly passes through the first portion 62. That is, the first portion 62 of the net 60 mainly attenuates the energy of the waves (flow) of the plating solution Q. Therefore, in the present embodiment, the whole including the first portion 62 and the second portion 63 of the net 60 is constituted by a net-like material, but at least the first portion 62 apart from the third side wall 14*c* or the fourth side wall 14*d* may be formed of a member having openings. Accordingly, the portion of the net 60 excluding the first portion 62 may be formed of any supporting member for supporting the first portion 62, for example.

In order to secure a space for accommodating the substrate holder 11, it is preferable that the net 60 is arranged at a place where it does not hinder the accommodation of the substrate holder 11. Specifically, it is preferable that the net 60 is arranged on at least one of a third side wall 14*c* side and a fourth side wall 14*d* side of the substrate holder 11 holding the substrate W. In the present embodiment, as shown in FIG. 6, the net 60 is arranged on each of the third side wall 14*c* side and the fourth side wall 14*d* side of the substrate holder 11, respectively.

In the present embodiment, the net 60 is arranged at a position facing the reciprocating direction of the paddle 16. Since the net 60 is arranged so as to face the traveling direction of the waves caused by the reciprocating movement of the paddle 16, the energy of the waves can be efficiently attenuated. However, the flow of the plating solution Q occurring due to the reciprocating movement of the paddle is complicated (for example, occurrence of a vortex), and the place where the net 60 is arranged is not limited to the above place.

The liquid level fluctuation reducing member of the present embodiment may be configured by overlapping plural nets 60. In this case, it is preferable that the liquid level fluctuation reducing member has a portion where the nets 60 overlap one another so that the openings of the nets 60 are shifted from one another. In the present embodiment, the two nets 60 are overlappingly formed in a substantially tubular shape so that the openings thereof are shifted from each other. That is, the first portion 62 of the net 60 is formed by overlapping two nets. As a result, the sizes of openings formed by the plural nets 60 become finer, and the energy of the waves (flow) of the plating solution Q passing through these openings can be efficiently attenuated. The size and arrangement of the openings of the net 60 are appropriately selected according to the moving speed and moving range of the paddle, and the size of the plating bath.

Furthermore, in the present embodiment, the net 60 is adopted as the liquid level fluctuation reducing member, but the present embodiment is not limited to this style. The present embodiment may adopt any member having a flow path through which the plating solution Q passes. For example, the liquid level fluctuation reducing member may be a sponge member having small holes, a punching plate having openings, a slit plate, and a cloth through which the plating solution Q can pass. Furthermore, the liquid level fluctuation reducing member may be configured by piling plural blocks and forming openings between the blocks.

Next, a plating method in the plating apparatus according to the present embodiment will be described. First, as shown in FIG. 6, the net 60 is arranged as the liquid level reducing member in the plating bath 14 in advance. Specifically, the net 60 may be arranged between the paddle 16 and the first side wall 14*a*. Furthermore, the net 60 may be arranged on at least one of the third side wall 14*c* side and the fourth side wall 14*d* side of the substrate W (or the substrate holder 11) placed in the plating bath 14. At least a part of the net 60 may be arranged to be apart from the third side wall 14*c* and the fourth side wall 14*d*. As described above, the liquid level fluctuation reducing member may be formed by overlapping the plural nets 60 so that the openings thereof are shifted from one another.

Subsequently, as shown in FIG. 3, the substrate W and the anode 26 are accommodated in the plating bath 14 while held by the substrate holder 11 and the anode holder 28, respectively. The paddle 16 is substantially horizontally linearly reciprocated along a plating target surface of the substrate W, and a voltage is applied between the substrate W and the anode 26 while stirring the plating solution Q accommodated in the plating bath 14. At this time, as the plating solution Q in the plating bath 14 passes through the openings (flow path) of the net 60, the net 60 increases the flow velocity of the plating solution Q passing through the openings, whereby the energy of the waves formed by the plating solution Q can be attenuated.

The embodiment of the present invention has been described above. The embodiment of the invention described above is to facilitate the understanding of the present invention, and does not limit the present invention. The present invention can be changed and improved without departing from the subject matter of the invention, and it is needless to say that equivalents of the embodiment are included in the present invention. In addition, it is possible to arbitrarily combine or omit the respective constituent elements described in Claims and the specification in a range where at least a part of the above-mentioned problem can be solved or a range where at least a part of the effect is exhibited.

Some of aspects disclosed in the present specification will be described below.

According to a first aspect, a plating apparatus for plating a substrate is provided. The plating apparatus includes: a plating bath configured to store plating solution; a paddle that is arranged in the plating bath and configured to stir the plating solution; and a liquid level fluctuation reducing member that is arranged in the plating bath, has a flow path through which the plating solution passes, and is configured to increase a flow velocity of the plating solution passing through the flow path to attenuate energy of waves formed by the plating solution.

According to the first aspect, the energy of the waves formed by the plating solution stirred by the paddle can be attenuated by the liquid level fluctuation reducing member. As a result, it is possible to reduce fluctuation of the liquid level of the plating solution caused by the operation of the paddle.

According to a second aspect, in the plating apparatus according to the first aspect, the plating bath has a first side wall positioned on the substrate side and a second side wall facing the first side wall and positioned on the anode side when the substrate and an anode are accommodated to face each other, and the liquid level fluctuation reducing member is arranged between the paddle and the first side wall.

When the paddle operates, the plating solution between the paddle and the first side wall, that is, the plating solution at a portion where the substrate is accommodated fluctuates greatly. Particularly, in a case where the paddle continues to operate when no plating process is performed in the plating bath, that is, when no substrate is temporarily accommodated in the plating bath, this fluctuation becomes most intense. According to the second aspect, since the liquid level fluctuation reducing member is arranged between the paddle and the first side wall, the fluctuation of the liquid level between the paddle and the first side wall where the plating solution greatly fluctuates can be efficiently reduced.

According to a third aspect, in the plating apparatus according to the second aspect, the plating bath has a third side wall and a fourth side wall through which the first side wall and the second side wall are connected to each other, and at least a part of the liquid level fluctuation reducing member is arranged apart from the third side wall and the fourth side wall.

According to the third aspect, at least a part of the liquid level fluctuation reducing member is arranged to be apart from the third side wall and the fourth side wall. As a result, a water retarding portion is formed between the part of the liquid level fluctuation reducing member and the third side wall or the fourth partition wall, and when the plating solution passing through the flow path of the liquid level fluctuation reducing member flows into the water retarding portion, the energy of the waves (flow) of the plating solution can be efficiently attenuated.

According to a fourth aspect, in the plating apparatus according to the third aspect, the liquid level fluctuation reducing member is arranged on at least one of the third side wall side and the fourth side wall side of the substrate placed in the plating bath.

According to the fourth aspect, the liquid level fluctuation reducing member does not hinder accommodation of the substrate.

According to a fifth aspect, in the plating apparatus according to any one of the first to fourth aspects, the paddle is configured to linearly reciprocate substantially horizontally along a plating target surface of the substrate placed in the plating bath, and a length in a vertical direction of the liquid level fluctuation reducing member is longer than a length in the vertical direction of a portion of the paddle which is immersed in the plating solution.

According to the fifth aspect, the liquid level fluctuation reducing member can attenuate the energy of the waves (flow) of the plating solution formed by the whole portion of the paddle which is immersed in the plating solution.

According to a sixth aspect, in the plating apparatus according to any one of the first to fifth aspects, the liquid level fluctuation reducing member is made of a net having plural openings.

According to the sixth aspect, the liquid level fluctuation reducing member may be constituted by an inexpensive material.

According to a seventh aspect, in the plating apparatus according to the sixth aspect, the liquid level fluctuation reducing member has a portion where the nets overlap so that the openings are shifted from one another.

According to the seventh aspect, the size of the openings formed by the net becomes finer, and the energy of the waves (flow) of the plating solution passing through the openings can be attenuated efficiently.

According to an eighth aspect, a plating method for plating a substrate is provided. The plating method includes a step of accommodating a substrate and an anode in a plating bath, a step of stirring plating solution stored in the plating bath, and a liquid level fluctuation reducing step of passing the plating solution in the plating bath through a predetermined flow path to increase a flow velocity of the plating solution passing through the flow path, thereby attenuating the energy of the waves formed by the plating solution.

According to the eighth aspect, the energy of the waves formed by the plating solution stirred by the paddle can be attenuated. As a result, it is possible to reduce fluctuation of the liquid level of the plating solution caused by the operation of the paddle.

According to a ninth aspect, in the plating method according to the eighth aspect, the plating bath has a first side wall positioned on the substrate side, and a second side wall facing the first side wall and positioned on the anode side when the substrate and the anode are accommodated to face each other, the step of stirring the plating solution includes a step of stirring the plating solution by using a paddle, and the liquid level fluctuation reducing step includes a step of passing the plating solution through the predetermined flow path equipped to the liquid level fluctuation reducing member arranged between the paddle and the first side wall.

When the paddle operates, the plating solution between the paddle and the first side wall, that is, the plating solution at a portion where the substrate is accommodated fluctuates greatly. Particularly, in a case where the paddle continues to operate when no plating is performed in the plating bath, that is, when no substrate is temporarily accommodated in the plating bath, this fluctuation becomes most intense. According to the ninth aspect, since the liquid level fluctuation reducing member is arranged between the paddle and the first side wall, the fluctuation of the liquid level between the paddle and the first side wall where the plating solution fluctuates greatly can be efficiently reduced.

According to a tenth aspect, in the plating method according to the ninth aspect, the plating bath has a third side wall and a fourth side wall that connect the first side wall and the second side wall, and the liquid level fluctuation reducing step includes a step of passing the plating solution through the predetermined flow path equipped to at least a part of the liquid level fluctuation reducing member arranged apart from the third side wall and the fourth side wall.

According to the tenth aspect, at least a part of the liquid level fluctuation reducing member is arranged apart from the third side wall and the fourth side wall. As a result, a water retarding portion is formed between a part of the liquid level fluctuation reducing member and the third side wall or the fourth partition wall, and when the plating solution passing through the flow path of the liquid level fluctuation reducing member flows into the water retarding portion, the energy of the waves (flow) of the plating solution can be efficiently attenuated.

According to an eleventh aspect, in the plating method according to the tenth aspect, the liquid level fluctuation reducing step includes a step for passing the plating solution through the predetermined flow path equipped to the liquid level fluctuation reducing member arranged on at least one of the third side wall side and the fourth side wall side of the substrate placed in the plating bath.

According to the eleventh aspect, the liquid level fluctuation reducing member does not hinder accommodation of the substrate.

According to a twelfth aspect, in the plating method according to any one of the eighth to eleventh aspects, the step of stirring the plating solution includes a step of linearly reciprocating the paddle substantially horizontally along a plating target surface of the substrate placed in the plating bath, and the liquid level fluctuation reducing step includes a step of passing the plating solution through the predetermined flow path equipped to the liquid level fluctuation reducing member having a length in a vertical direction which is longer than a length in the vertical direction of a portion of the paddle which is immersed in the plating solution.

According to the twelfth form, the liquid level fluctuation reducing member can attenuate the energy of the waves (flow) of the plating solution formed by the whole portion of the paddle which is immersed in the plating solution.

According to a thirteenth aspect, in the plating method according to any one of the eighth to twelfth aspects, the liquid level fluctuation reducing member is made of a net having plural openings.

According to the thirteenth aspect, the liquid level fluctuation reducing member can be constituted by an inexpensive material.

According to a fourteenth aspect, in the plating method according to the thirteenth aspect, the liquid level fluctuation reducing step includes a step of overlapping the nets so that the openings of the nets are shifted from each other.

According to the fourteenth aspect, the size of the openings formed by the nets becomes finer, and the energy of waves (flow) of the plating solution passing through the openings can be attenuated efficiently.

REFERENCE SIGNS LIST

11 . . . substrate holder
14 . . . plating bath
14*a* . . . first side wall
14*b* . . . second side wall
14*c* . . . third side wall
14*d* . . . fourth side wall
16 . . . paddle
26 . . . anode
60 . . . net
62 . . . first portion
63 . . . second portion
Q . . . plating solution
W . . . substrate

What is claimed is:

1. A plating apparatus for plating a substrate comprising:

a plating bath configured to store plating solution, the plating bath having a first side wall positioned on the substrate side, a second side wall facing the first side wall and positioned on an anode side when the substrate and the anode are accommodated to face each other, and a third side wall connecting the first sidewall and the second sidewall and a fourth side wall connecting the first side wall and the second side wall;

a paddle that is arranged in the plating bath and configured to stir the plating solution; and a liquid level fluctuation reducing member that is arranged in the plating bath, has plural openings through which the plating solution passes to increase flow velocity of the plating solution to attenuate energy of waves formed by the plating solution, wherein the liquid level fluctuation reducing member is arranged at a position facing a reciprocating direction of the paddle, and comprise a first portion having the plural openings, the first portion being apart from the third side wall and the fourth side wall of the plating bath, and forming a water retarding portion between the first portion and the plating bath, and the liquid level fluctuation reducing member is located between the location of the substrate and the third side wall or the fourth side wall.

2. The plating apparatus according to claim 1, wherein the liquid level fluctuation reducing member is arranged between the paddle and the first side wall.

3. The plating apparatus according to claim 2, wherein the liquid level fluctuation reducing member is arranged on at least one of a third side wall side and a fourth side wall side of the substrate placed in the plating bath.

4. The plating apparatus according to claim 1, wherein the paddle is configured to linearly reciprocate substantially horizontally along a plating target surface of the substrate placed in the plating bath, and a length in a vertical direction of the liquid level fluctuation reducing member is longer than a length in the vertical direction of a portion of the paddle which is immersed in the plating solution.

5. The plating apparatus according to claim 1, wherein the liquid level fluctuation reducing member is made of a net.

6. The plating apparatus according to claim 5, wherein the liquid level fluctuation reducing member has plurality of nets, the liquid level fluctuation reducing member has a portion where the nets overlap so that the openings of the net are shifted from one another.

* * * * *